US007438561B2

(12) United States Patent
Chen

(10) Patent No.: US 7,438,561 B2
(45) **Date of Patent: *Oct. 21, 2008**

(54) ELECTRICAL CONNECTOR FOR A PRINTED CIRCUIT BOARD

(75) Inventor: Chao Chen, Waterloo (CA)

(73) Assignee: Research In Motion Limited, Waterloo, Ontario (CA)

( * ) Notice: Subject to any disclaimer, the term of this patent is extended or adjusted under 35 U.S.C. 154(b) by 0 days.

This patent is subject to a terminal disclaimer.

(21) Appl. No.: 11/765,500

(22) Filed: Jun. 20, 2007

(65) Prior Publication Data

US 2008/0026633 A1 Jan. 31, 2008

(51) Int. Cl.
*H01R 12/00* (2006.01)

(52) U.S. Cl. ..... 439/79

(58) Field of Classification Search ..... 439/630, 439/79, 80, 862, 652, 629
See application file for complete search history.

(56) References Cited

U.S. PATENT DOCUMENTS 5,885,090 A * 3/1999 Comstock et al. ..... 439/65
6,031,726 A 2/2000 Vinciarelli et al.
6,190,213 B1 2/2001 Reichart et al.
6,293,818 B1 9/2001 Kim et al.
6,315,520 B1 * 11/2001 Haje et al. ..... 415/178
6,315,620 B1 11/2001 Moir et al.
6,447,338 B1 9/2002 Bricaud et al.
6,456,504 B1 9/2002 LoForte et al.
6,623,281 B2 9/2003 Vinciarelli et al.
6,719,594 B1 4/2004 Yuzawa
6,814,583 B1 11/2004 Young et al.
6,855,013 B2 2/2005 Chiang et al.
6,997,743 B1 * 2/2006 Su et al. ..... 439/567
6,997,752 B2 2/2006 Kato et al.
2002/0042212 A1 4/2002 Michaud et al.
2004/0033723 A1 * 2/2004 Bricaud et al. ..... 439/630
2005/0130510 A1 6/2005 Zheng et al.
2005/0233602 A1 10/2005 Link
2006/0003634 A1 * 1/2006 Jeong ..... 439/630

* cited by examiner

*Primary Examiner*—Phuong K Dinh
(74) *Attorney, Agent, or Firm*—Carol A. Marmo; Brij K. Agarwal; Eckert Seamans Cherin & Mellott, LLC

(57) ABSTRACT

An electrical connector is provided. The electrical connector has a housing which is supportable within an aperture of a printed circuit board. The electrical connector also has one or more electrical contacts that are disposed on the housing with at least some of the contacts each having a connectable portion extending from the housing in a direction generally parallel with a first axis. The electrical connector also has a number of opposed projections extending from the housing in a direction generally parallel with a second axis. The first axis is generally perpendicular to the second axis. The one or more contacts include a deflectable biasing portion which extends outwardly from the housing and which is structured to be electrically connected with the device.

19 Claims, 5 Drawing Sheets

ELECTRICAL CONNECTOR FOR A PRINTED CIRCUIT BOARD

BACKGROUND

1. Parent Case Text

This patent application claims priority to U.S. patent application Ser. No. 11/460,381, filed Jul. 27, 2006, the contents of which is hereby incorporated by reference into this patent application in its entirety as if fully set forth herein.

2. Technical Field

The disclosure generally relates to an electrical connector. The disclosure also relates to an electrical connector for a printed circuit board.

3. Background Information

Generating text in a handheld electronic device examples of which include, for instance, personal data assistants (PDA's), handheld computers, two-way pagers, cellular telephones, text messaging devices, and the like, has become a complex process. This complexity is due at least in part to a trend in making these handheld electronic devices thinner and lighter in weight.

A limitation in making these handheld electronic devices thinner has been the added thickness of an electrical connector connected to a printed circuit board contained within a housing of the handheld electronic device. The electrical connector is used to establish an electrical connection between conductive elements of the printed circuit board and a conductive portion of another device such as, for example, a liquid crystal display ("LCD"). LCD's are used in many products such as, for example, handheld electronic devices, television sets, camcorders, computer monitors, audio/visual equipment, car navigation systems, gaming devices and the like.

A problem with certain existing electrical connectors is that a housing of the connector carries a plurality of electrical contacts and must be disposed on a circuit board for connection therewith. Such an approach adds unnecessary thickness to a device containing the electrical connector. Accordingly, there is room for improvement in electrical connectors. There is also room for improvement in electrical connectors for printed circuit boards.

DESCRIPTION

Figure 1:
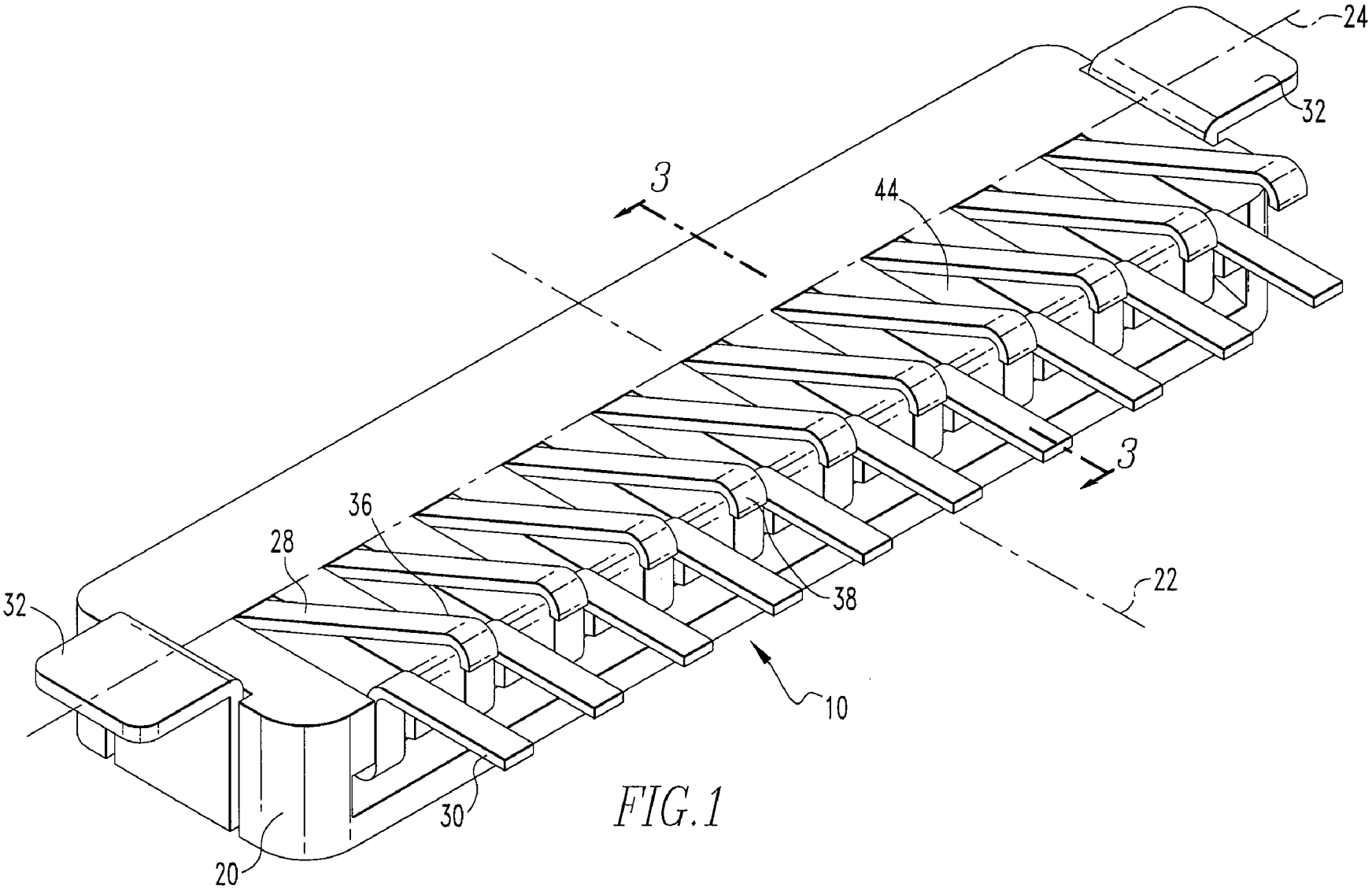
FIG. 1 is a top perspective view of an electrical connector.
Figure 2:
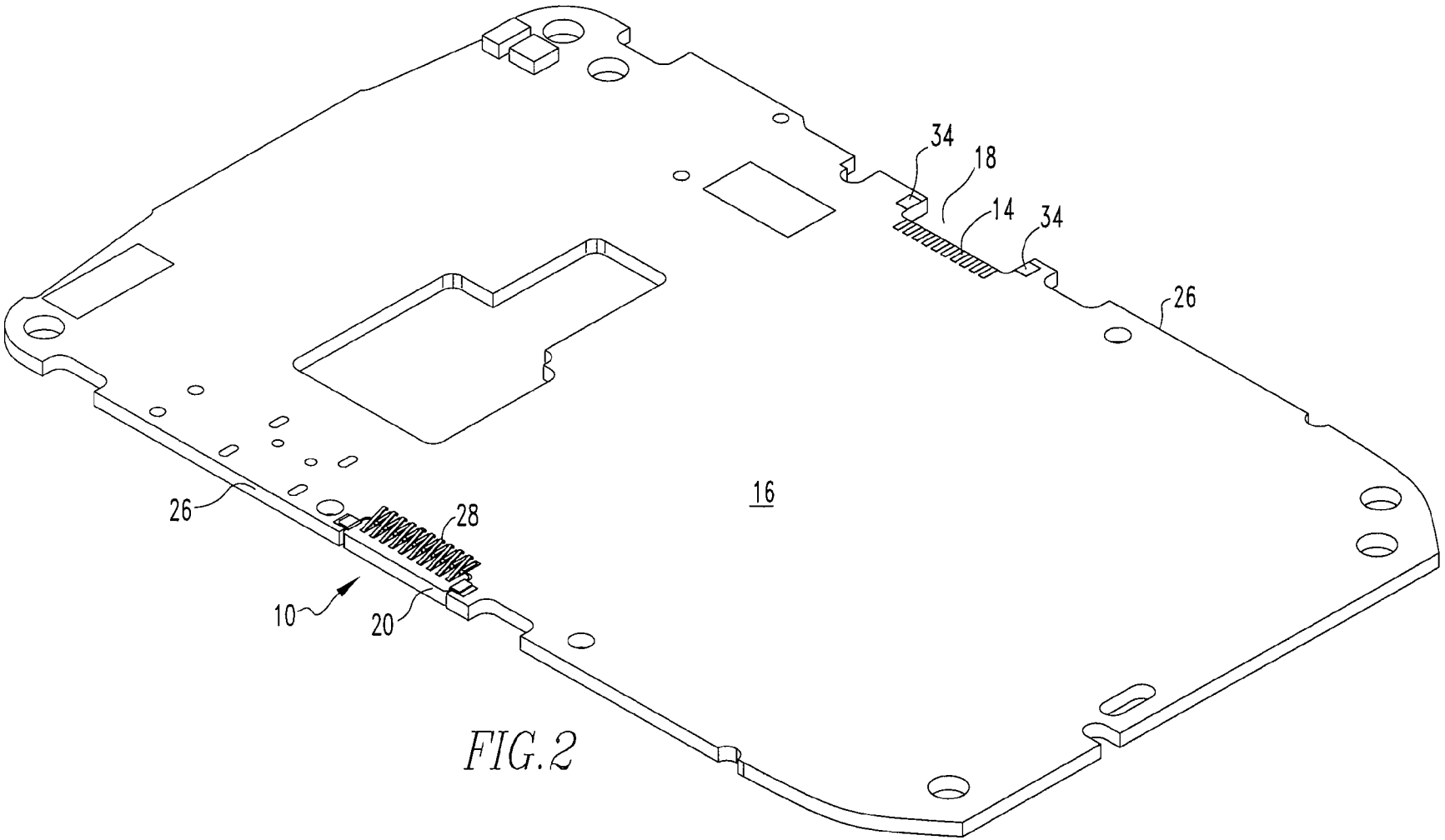
FIG. 2 is a top perspective view of the electrical connector of FIG. 1 connected to a printed circuit board and disposed within an aperture formed in the printed circuit board.
Figure 3:
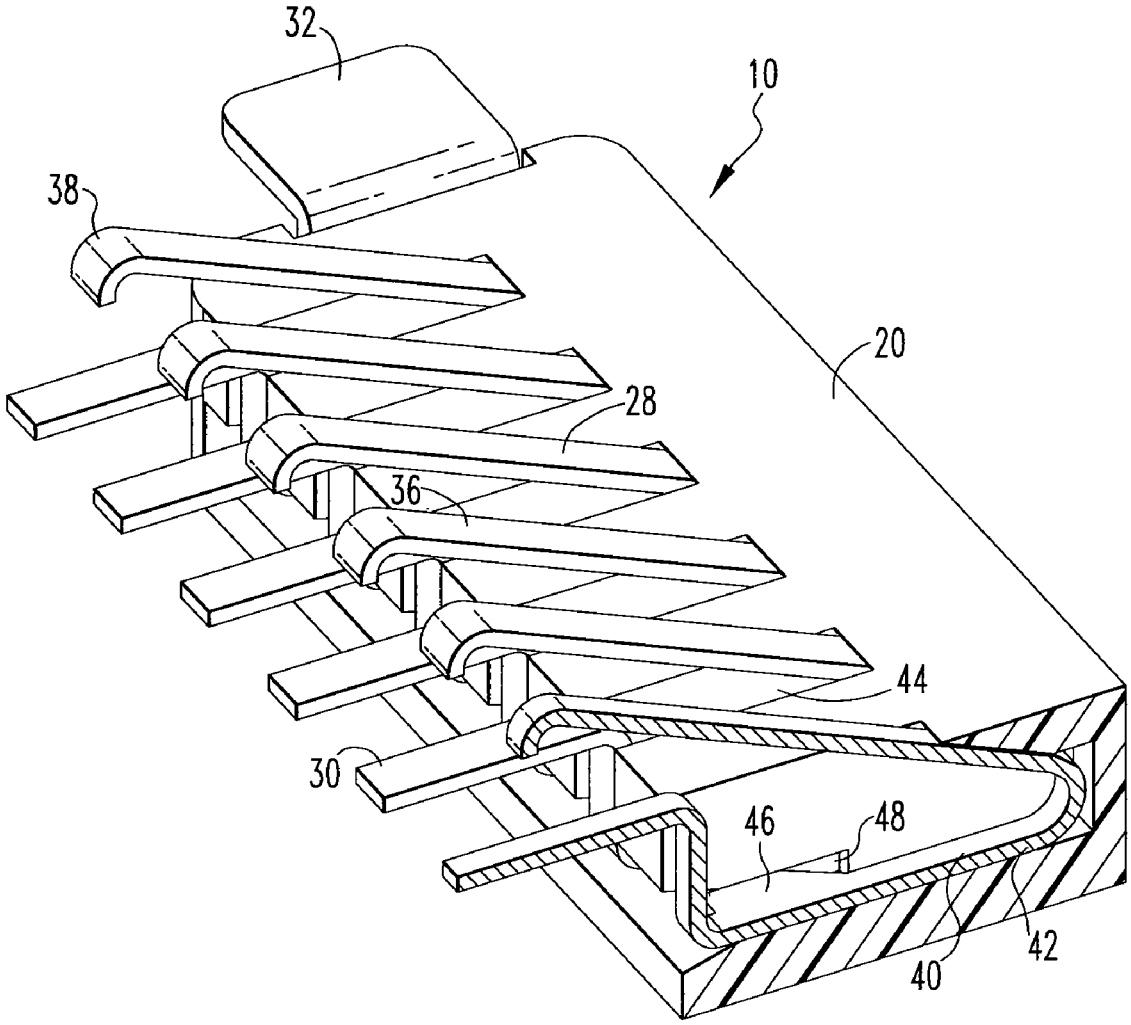
FIG. 3 is a top perspective partial cross-sectional view as taken along line 3-3 of FIG. 1.
Figure 4:
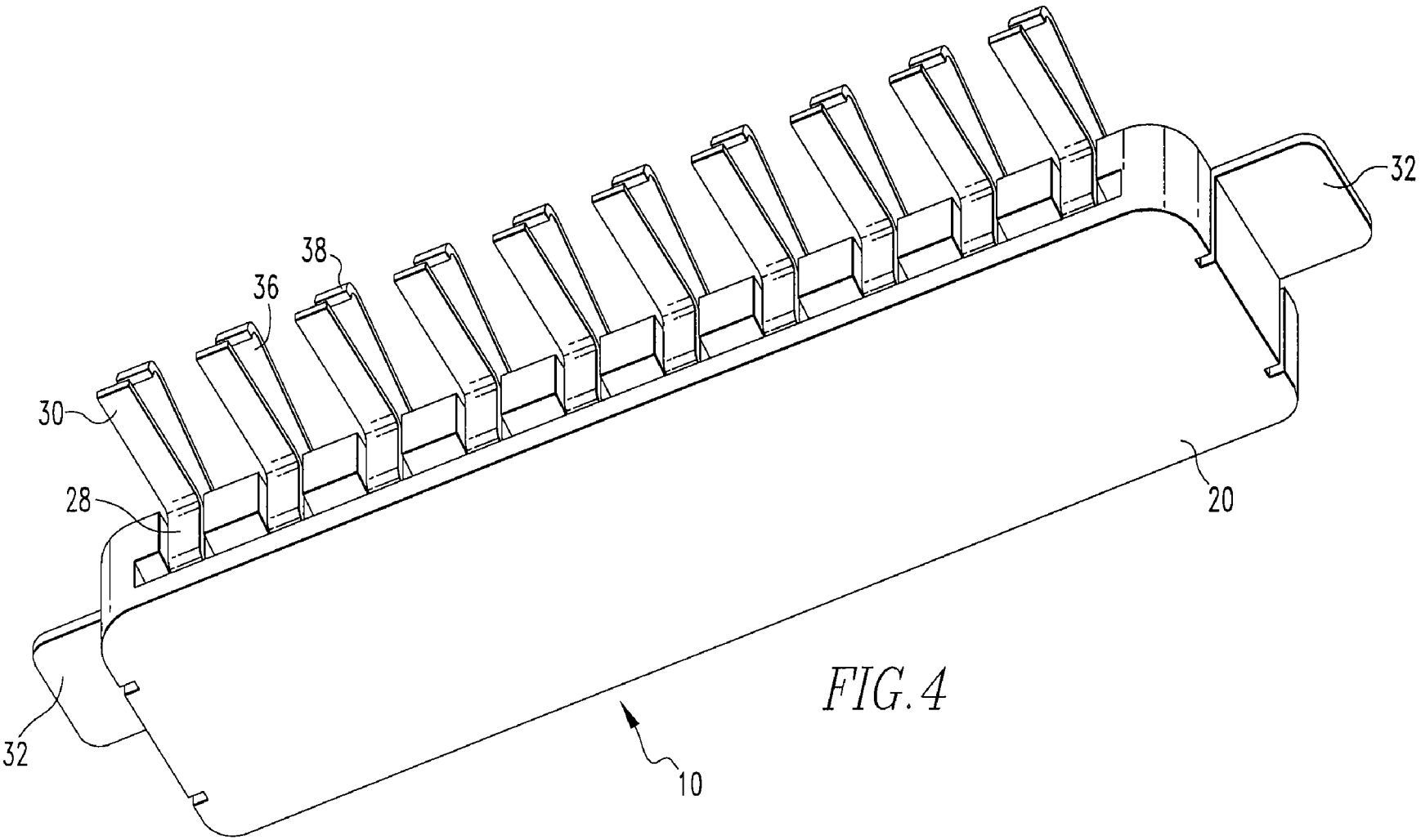
FIG. 4 is a bottom perspective view of the electrical connector of FIG. 1.

FIGS. 1-4 illustrate an electrical connector 10. With reference to FIG. 2, the electrical connector 10 enables an electrical connection between a conductive portion of a device 12 such as a LCD and conductive elements 14 of a printed circuit board 16 having an aperture 18 formed therein. The electrical connector 10 has a housing 20. A first axis 22 can be said to extend along a first direction with respect to the housing 20. A second axis 24 can be said to extend along a second direction with respect to the housing 20. As can be seen, the first axis 22 intersects the second axis 24 and the axes 22, 24 are generally perpendicular to each other. The housing 20 is structured to be supportable within the aperture 18 of the printed circuit board 16. The electrical connector 10 is shown connected on an edge 26 of the printed circuit board 14.

One or more electrical contacts 28 are disposed on the housing 20. At least some of the electrical contacts 28 each have a connectable portion 30 extending outwardly from the housing 18 in a direction generally parallel with the first axis 22. The connectable portion 30 is structured to be connected to the conductive elements 14 of the printed circuit board 16. The conductive elements 14 may be soldered to the printed circuit board 16 via surface mount technology techniques or connected by other similar connecting mechanisms. Each electrical contact 28 is structured to be electrically connected with the device 12.

A number of projections 32 extend outwardly from the housing 18 in a direction generally parallel with the second axis 24. The projections 32 are structured to be coupled to pads 34 provided on the printed circuit board 14. The projections 32 may be opposed to one another as well. The connectable portion 30 and the projections 32 each have a mounting surface lying generally in a common plane. The projections 32 may be soldered to the pads 34 via surface mount technology techniques or connected by other similar connecting mechanisms. The projections 32 could be made from a piece of metal that extends along an entire length of the housing 20 in a direction of the second axis 24. The metal could, for example, be inserted and molded into the housing 20. Alternatively, the projections 32 could be made from at least a number of pieces of metal that extend along a portion of the length or the entire length of the housing 20 in the direction of the second axis 24. This metal could, for example, be inserted and molded into the housing 18 as well. As can be appreciated, other approaches exist for securing metal that forms projections 32 to the housing 18. By way of example and not of limitation, the metal could be connected to the housing 20 by snap fitting the metal into one or more channels (not shown) formed within the housing 20. While two projections 32 are shown in the FIGS., one would appreciate that any number of projections 32 could be used in the disclosed and claimed concepts of the patent application and the disclosure in the FIGS. should not be considered limiting.

Each electrical contact 28 may include a deflectable portion 36 to be electrically connected to the device 12. Each electrical contact 28 may also include an arcuate tip 38. Each electrical contact 28 is located in the housing 18 in spaced relation to the other electrical contacts 28. Generally speaking, each electrical contact 28 is spaced in an equidistant relationship from an adjacent electrical contact 28 of the electrical connector 10. While each electrical contact 28 is shown in the FIGS. in a spaced equidistant relationship from an adjacent electrical contact 28, one would appreciate that the electrical contacts 28 do not necessarily have to be provided in a spaced equidistant relationship from an adjacent electrical contact 28 and that each electrical contact 28 could be provided in a spaced non-equidistant relationship from an adjacent electrical contact 28, and the disclosed and claimed concepts of the patent application and the disclosure in the FIGS. should not be considered limiting.

Each deflectable portion 36 is biased and extends outwardly from the housing 18 and is structured to be electrically connected with the device 12. The biased deflectable portion 36 may also have an arcuate tip 38 as well. The biased deflectable portion 36 is biased toward the device 12 electrically connected thereto. The biased deflectable portion 36 also overlies at least a portion of the connectable portion 30.

Figure 5:
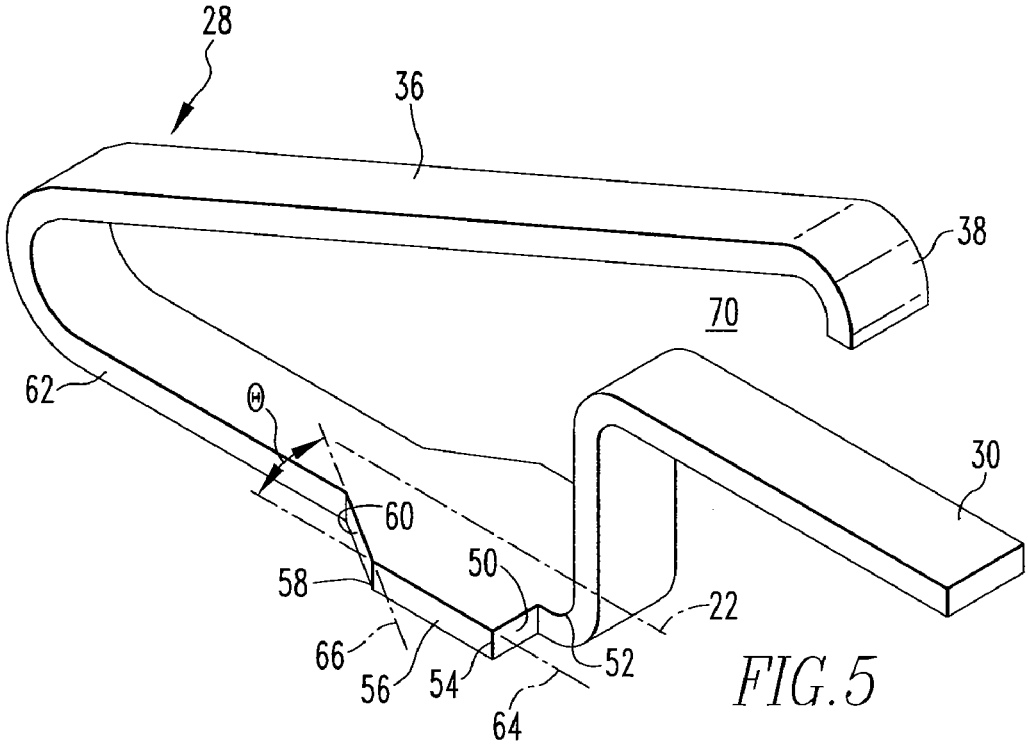
FIG. 5 is a top perspective view of an electrical contact of the electrical connector of FIG. 1.

Each electrical contact 28 may also have a housing portion 40 disposed on the housing 18 which extends between the connectable portion 30 and the deflectable portion 36. A portion 42 of the housing portion 40 may be received within a number of apertures 44 formed within the housing 18. The portion 42 of the housing portion 40 may be secured to the housing 18 by placing or snapping barbs 46 within suitably structured recesses 48 proximate to the apertures 44. As can be seen in FIG. 5, the barb 46 has a first edge 50 adjacent to a radius 52 that connects the housing portion 40 to the connectable portion 30. The first edge 50 extends outwardly in a direction generally perpendicular to the first axis 22 and has opposite ends 54. The opposite ends 54 of the first edge 50 have a second edge 56 attached to one of the opposite ends 54. The second edges 56 are located in opposed relationship to each other and extend outwardly from one of the opposite ends 54 in a general direction of the first axis 22. At a terminus 58 of the second edges 56, the second edges 56 are connected to a tapered portion 60 which gradually tapers and ends at a third edge 62 which extends in a general direction of the first axis 20. An axis 64 which extends along the second edge 56 forms an angle, $\theta_1$ with an axis 66 that extends along the tapered portion 60. $\theta_1$ may have a value of approximately 5 degrees to approximately 85 degrees. It should be noted that $\theta_1$ may have a value of anywhere between about 5 degrees to about 85 degrees and other ranges falling within that range.

As can be seen in FIG. 2, the connectable portion 30 and the projections 32 are structured to lie substantially flush with a surface of the printed circuit board 16. At least a portion of the electrical connector 10 is structured to be surface mounted to the printed circuit board 16. The projections 32 support the electrical connector 10 within the aperture 18 of the printed circuit board 16. Such an approach minimizes the overall thickness of a product containing the electrical connector 10. By way of example and not of limitation, such products may be handheld electronic devices, television sets, camcorders, computer monitors, audio/visual equipment, car navigation systems, gaming devices and the like. The industry is continuously striving to reduce the overall thicknesses of a variety of electronic devices.

Figure 6:
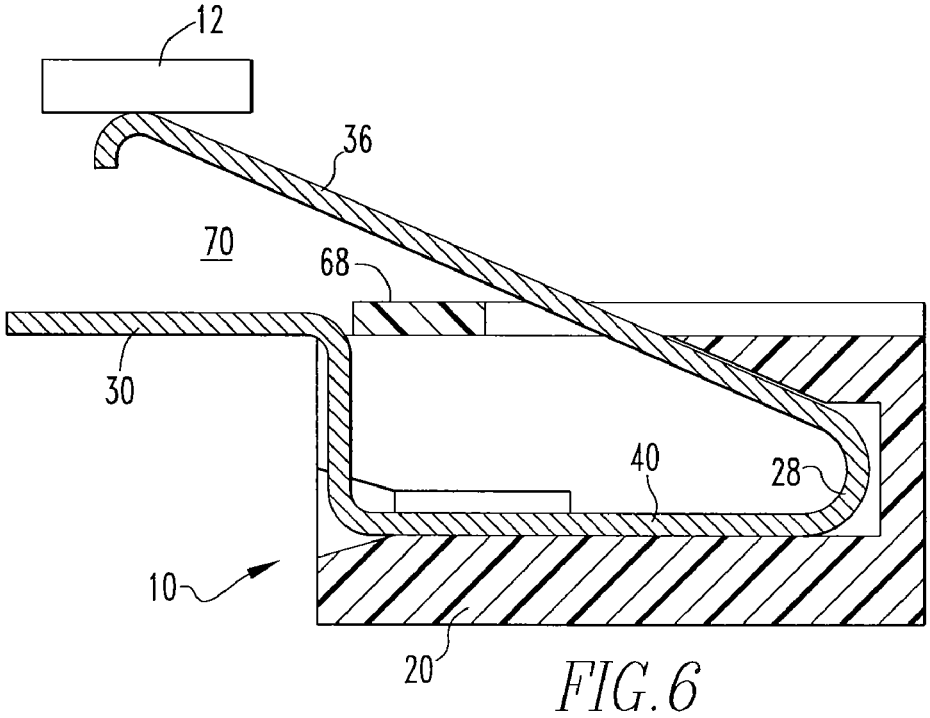
FIG. 6 is a side cross-sectional view as taken along line 3-3 of FIG. 1.

As can be seen in FIG. 6, a small amount of optional cushion material 68 having a thickness of approximately 0.012 inch (0.3 mm) may be interposed between the device 12 such as a LCD and the electrical connector 10. The deflectable portion 36 and the connectable portion 30 are in a spaced relationship from one another to define a gap 70 therebetween to accommodate the optional amount of cushion material 68 used between the device 12 and the printed circuit board 16, if any. As can be appreciated, the electrical connector 10 may be constructed to provide any amount of preselected gap 70 between the deflectable portion 36 and the connectable portion 30.

While specific embodiments of the disclosed and claimed concepts have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed and claimed concepts which is to be given the full breadth of the claims appended and any and all equivalents thereof.

What is claimed is:

1. An electrical connector for enabling an electrical connection between a conductive portion of a device and conductive elements of a printed circuit board having an aperture formed therein, the electrical connector comprising:

a housing being structured to have an entire thickness of the housing supportable within the aperture of the printed circuit board;

one or more electrical contacts disposed on the housing, at least some of the contacts each having a connectable portion extending from the housing in a direction generally parallel with a first axis, the connectable portion being structured to be connected to the printed circuit board, each electrical contact being structured to be electrically connected with the device; and a number of opposed projections extending from the housing in a direction generally parallel with a second axis, the projections being structured to be coupled to the printed circuit board, wherein the connectable portion and the projections are structured to lie substantially flush with a surface of the printed circuit board.

2. The electrical connector of claim 1, wherein the first axis is generally perpendicular to the second axis.

3. The electrical connector of claim 1, wherein each electrical contact comprises a deflectable portion to be electrically connected with the device.

4. The electrical connector of claim 1, wherein each electrical contact has an arcuate tip.

5. The electrical connector of claim 1, wherein the one or more contacts include a deflectable biasing portion which extends outwardly from the housing and which is structured to be electrically connected with the device, and a housing portion being disposed on the housing and extending between the connectable portion and the deflectable biasing portion.

6. The electrical connector of claim 5, wherein a portion of the housing portion is received within a number of apertures formed in the housing.

7. The electrical connector of claim 1, wherein at least a portion of the connector is structured to be surface mounted to the printed circuit board.

8. The electrical connector of claim 1, wherein the projections support the connector within the aperture of the printed circuit board.

9. The electrical connector of claim 1, wherein the electrical contacts have a housing portion having a barb, wherein the barb has a first edge that extends outwardly in a direction generally perpendicular to the first axis, wherein the first edge has opposite ends, wherein the opposite ends of the first edge have second edges attached to one of the opposite ends, wherein the second edges are located in opposed relationship to each other and extend outwardly from one of the opposite ends in a general direction of the first axis, and wherein the second edges have a terminus connected to a tapered portion which ends at a third edge which extends outwardly in a general direction of the first axis.

10. The electrical connector of claim 9, wherein an axis extends along the second edge forms an angle, $\theta_1$ with an axis that extends along the tapered portion and wherein $\theta_1$ has a value of approximately 5 degrees to approximately 85 degrees.

11. An electrical connector for enabling an electrical connection between a conductive portion of a device and conductive elements of a printed circuit board having an aperture formed therein, the electrical connector comprising:

a housing being structured to be supportable within the aperture of the printed circuit board;

one or more electrical contacts disposed on the housing, at least some of the contacts each having a connectable portion extending from the housing in a direction generally parallel with a first axis, the connectable portion being structured to be connected to the printed circuit board, each electrical contact being structured to be electrically connected with the device; and a number of opposed projections extending from the housing in a direction generally parallel with a second axis, the projections being structured to be coupled to the printed circuit board, wherein the electrical contacts have a housing portion having a barb, wherein the barb has a first edge that extends outwardly in a direction generally perpendicular to the first axis, wherein the first edge has opposite ends, wherein the opposite ends of the first edge have second edges attached to one of the opposite ends, wherein the second edges are located in opposed relationship to each other and extend outwardly from one of the opposite ends in a general direction of the first axis, and wherein the second edges have a terminus connected to a tapered portion which ends at a third edge which extends outwardly in a general direction of the first axis.

12. The electrical connector of claim 11, wherein the connectable portion and the projections are structured to lie substantially flush with a surface of the printed circuit board, and wherein the first axis is generally perpendicular to the second axis.

13. The electrical connector of claim 11, wherein each electrical contact comprises a deflectable portion to be electrically connected with the device.

14. The electrical connector of claim 11, wherein each electrical contact has an arcuate tip.

15. The electrical connector of claim 11, wherein the one or more contacts include a deflectable biasing portion which extends outwardly from the housing and which is structured to be electrically connected with the device, and a housing portion being disposed on the housing and extending between the connectable portion and the deflectable biasing portion.

16. The electrical connector of claim 15, wherein a portion of the housing portion is received within a number of apertures formed in the housing.

17. The electrical connector of claim 11, wherein at least a portion of the connector is structured to be surface mounted to the printed circuit board.

18. The electrical connector of claim 11, wherein the projections support the connector within the aperture of the printed circuit board.

19. The electrical connector of claim 11, wherein an axis extends along the second edge forms an angle, $\theta_1$ with an axis that extends along the tapered portion and wherein $\theta_1$ has a value of approximately 5 degrees to approximately 85 degrees.

* * * * *